US009013256B2

(12) United States Patent
Simonin

(10) Patent No.: US 9,013,256 B2
(45) Date of Patent: Apr. 21, 2015

(54) SOLENOID COIL HAVING AN ENHANCED MAGNETIC FIELD

(75) Inventor: Stephen P. Simonin, Northfield, CT (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 13/422,797

(22) Filed: Mar. 16, 2012

(65) Prior Publication Data

US 2013/0241675 A1 Sep. 19, 2013

(51) Int. Cl.

| | |
|---|---|
| ***H01H 73/12*** | (2006.01) |
| ***H01H 73/00*** | (2006.01) |
| ***H01H 83/06*** | (2006.01) |
| ***H01F 7/08*** | (2006.01) |
| ***H01F 3/00*** | (2006.01) |
| ***H01H 50/44*** | (2006.01) |
| ***H01H 71/24*** | (2006.01) |

(52) U.S. Cl.

CPC ..... *H01H 50/44* (2013.01); *H01H 71/2481* (2013.01)

(58) Field of Classification Search

CPC ..... H01H 83/04
USPC ..... 335/256, 126, 18
See application file for complete search history.

(56) References Cited

U.S. PATENT DOCUMENTS

| | | | | |
|---|---|---|---|---|
| 1,872,369 | A | 8/1932 | Van Sickle | |
| 2,407,603 | A * | 9/1946 | Derungs | 361/206 |
| 2,472,553 | A * | 6/1949 | Theunissen | 361/154 |
| 2,881,367 | A * | 4/1959 | Watson | 335/256 |
| 3,571,770 | A * | 3/1971 | Dew | 335/256 |
| 4,065,096 | A * | 12/1977 | Frantz et al. | 251/129.1 |
| 7,088,207 | B2 * | 8/2006 | Siedelhofer et al. | 335/234 |
| 7,990,663 | B2 | 8/2011 | Ziegler et al. | |

* cited by examiner

*Primary Examiner* — Alexander Talpalatski
(74) *Attorney, Agent, or Firm* — Michael Best & Friedrich, LLP

(57) ABSTRACT

An improved solenoid having an enhanced magnetic field and failsafe operation is provided, wherein a primary winding and a secondary winding are constructed such that the combined force imparted on a plunger by both windings energized together is greater than the sum of the forces imparted by the primary and secondary windings energized separately, resulting in a smaller solenoid capable of providing a predetermined force, and providing a solenoid capable of tripping a circuit interrupting latch even if one of the windings is broken.

13 Claims, 9 Drawing Sheets

SOLENOID COIL HAVING AN ENHANCED MAGNETIC FIELD

CROSS REFERENCE TO RELATED APPLICATIONS

This application contains subject matter related to subject matter contained in copending U.S. Patent Applications filed on even date herewith, application numbers not assigned yet, entitled "REINSTALLABLE CIRCUIT INTERRUPTING DEVICE WITH VIBRATION RESISTANT MISWIRE PROTECTION," by Gaetano Bonasia, et al., "COMPACT LATCHING MECHANISM FOR SWITCHED ELECTRICAL DEVICE," by Gaetano Bonasia and Kenny Padro, and "ENHANCED AUTO-MONITORING CIRCUIT AND METHOD FOR AN ELECTRICAL DEVICE," by Gaetano Bonasia and Kenny Padro, which applications are assigned to the assignee hereof, and the entire contents of each of which are expressly incorporated herein by reference.

FIELD OF THE INVENTION

The present invention relates to solenoids. More particularly, the present invention relates to improved solenoids providing equivalent plunger force with smaller size, for use in ground fault circuit interrupters (GFCIs).

BACKGROUND OF THE INVENTION

Ground Fault Circuit Interrupters (GFCIs) are important safety devices that are common in households and commercial buildings. GFCIs protect users from being electrocuted by monitoring the current flowing in a circuit, and tripping, or opening, the circuit to remove power if an imbalance of current is detected. Conventional GFCIs utilize a solenoid coil to convert electrical energy into mechanical energy in order to trip the device and open one or more sets of electrical contacts. In the conventional arrangement the solenoid comprises a single electrical winding that forms a primary coil having a hollow core with an inner diameter, an outer diameter, a length and a given number of turns of electrical wire. When the solenoid is electrically energized the electrical windings generate a magnetic field that imparts a force upon a plunger located in the hollow core of the solenoid. The plunger in turn moves, and in a conventional GFCI, pushes a spring biased latch mechanism from a latched position to an unlatched position, thereby opening the electrical contacts to remove power from the protected circuit.

The parameters of the solenoid coil are selected to impart a given force upon the plunger that is sufficient to move the latch mechanism. In addition, solenoid coils must be designed with variable operating conditions, such as temperature range, taken into consideration. With higher operating temperatures come higher impedance in the solenoid coil wire, resulting in lower current, smaller magnetic field, and thus lower force imparted on the plunger. Yet another consideration is the need for a failsafe backup operation. If the solenoid coil wire breaks or short circuits, the solenoid can fail to operate or severely reduce the force imparted on the plunger, possibly causing the device not to trip when a fault is detected.

Yet another consideration in the design of solenoid coils is the size of the coil. Typically, solenoids that are required to provide higher force must be made larger to accommodate higher numbers of electrical wire windings. Accordingly, there is a trade-off in the designed force imparted by a solenoid coil and its size. In compact devices the trade-off between size and force capability becomes critical. In particular, Hubbell SnapConnect GFCI devices, which provide a simplified "plug and receptacle" design for connecting a GFCI receptacle to building wiring, have limited internal space as compared to conventional GFCI receptacles, due to the SnapConnect features molded into the housing.

U.S. Pat. No. 1,872,369 to Van Sickle describes a solenoid arranged with three parallel coils and six pins or terminals. The three parallel coils are connected in various arrangements and combinations (parallel and serial) to arrive at a wide variety of pull force, given the same input voltage, or alternately to obtain the same pull force given a different input voltage. The Van Sickle arrangement provides flexibility at the cost of size, and accordingly does not provide a solenoid of reduced size for a given force requirement. The Van Sickle device also does not provide for arranging two or more separate solenoid coils in a manner to enhance the force imparted on a plunger within the solenoid.

U.S. Pat. No. 7,990,663 to Ziegler et al. describes a GFCI device that includes a solenoid coil and an additional "test coil." The test coil may be energized along with the solenoid coil, but the two coils are not arranged to enhance the force imparted on the plunger. Rather, for example, in one embodiment, the two coils are arranged with opposite polarity, and the test coil is larger than the main coil. Operating both coils together results in the plunger being driven in the opposite direction since the test coil is larger than the primary coil and oriented in the opposite direction. In this manner operation of the solenoid may be confirmed without tripping the contacts. In another embodiment, the test coil is used merely to sense movement of the plunger, and does not enhance the force applied to the plunger. Ziegler does not address the issue of reducing the size of the solenoid coil, but rather adds a second coil used for testing, and accordingly requires additional space within the GFCI housing.

Accordingly, there is a need for an improved solenoid coil, primarily for use in compact GFCI devices, that is smaller in size but still provides the required predetermined mechanical force to trip the device, and that preferably provides back-up capability in the event of a wire break or short circuit in the solenoid winding.

SUMMARY OF THE INVENTION

Embodiments of the present invention advantageously provide a solenoid that includes a bobbin having a hollow center with a metal plunger therein. The solenoid includes a primary winding that has a starting end and a terminating end that is wound on the bobbin and imparts a first magnetic force, that is greater than a predetermined force, on the plunger when the primary winding is electrically energized. The solenoid also includes a secondary winding that has a starting end and a terminating end that is wound on top of the primary winding. The secondary winding imparts a second magnetic force, that is also greater than the predetermined force, on the plunger when the secondary winding is electrically energized. When the primary and secondary windings are energized together, a third magnetic force is imparted on the plunger. The third magnetic force is greater than the combination of said first and second magnetic forces.

Embodiments of the present invention provide a method of forming a solenoid comprising a bobbin having a hollow center with a metal plunger therein. The method comprises winding a primary winding onto a bobbin. The primary winding is sufficient to impart a first magnetic force on the plunger greater than a predetermined force. The method further includes winding a secondary winding on top of the primary winding, the secondary winding being sufficient to impart a second magnetic force on the plunger when the secondary winding is electrically energized. The second magnetic force is also greater than the predetermined force. When the primary and secondary windings are energized together, a third magnetic force is imparted on the plunger. The third magnetic force is greater than a combination of the first and second magnetic forces.

Embodiments of the present invention provide a method of operating a solenoid comprising a bobbin having a hollow center with a metal plunger therein. The method includes winding a primary winding onto the bobbin. The primary winding is sufficient to impart a first magnetic force on the plunger. The first magnetic force is greater than a predetermined force. The method also includes winding a secondary winding on top of the primary winding. The secondary winding is sufficient to impart a second magnetic force on the plunger when the secondary winding is energized. The second magnetic force is also greater than the predetermined force. The method includes energizing the primary and secondary windings together when the primary and secondary windings are each unbroken, and thereby imparting a third magnetic force on the plunger. The third magnetic force is advantageously greater than the combination of the first and second magnetic forces. If the secondary winding is broken, the method includes energizing the primary winding to impart the first magnetic force on the plunger.

BRIEF DESCRIPTION OF THE DRAWING FIGURES

These and other features and advantages of the present invention will become more apparent from the detailed description of exemplary embodiments with reference to the attached drawings in which.

Thoughout the drawings, like reference numerals will be understood to refer to like features and structures.

DETAILED DESCRIPTION OF EXEMPLARY EMBODIMENTS

Figure 1:
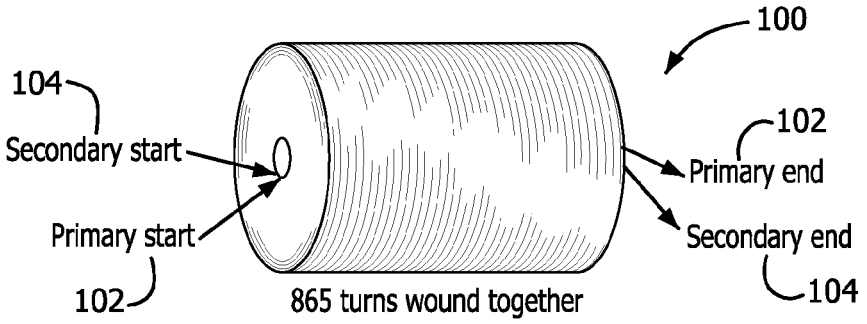
FIG. 1 is a diagram illustrating a first coil according to a first embodiment of the present invention.

A number of experiments were conducted with single winding and multiple winding solenoid coils, as will be described below. Standard GFCI coils have 1200 turns of 34 American Wire Gauge (AWG) wire. The resistance and wire size of four wire types were measured for comparison, and the results are in the following table:

| AWG | OD mils | OD measured with insulation | Ohms/1000' |
|---|---|---|---|
| 33 | 7.1 | 8 | 211 |
| 34 | 6.3 | 7 | 266 |
| 35 | 5.6 | 6.5 | 335 |
| 36 | 5 | 5 | 423 |

As can be appreciated from the above table, as AWG increases (that is, wire OD decreases) the electrical resistance of the wire increases. Next, a series of tests were conducted by modifying a standard solenoid coil having 1200 turns of 34 AWG wire, and modifying the coil by adding or removing turns of wire. As can be appreciated, a standard 1200 turn coil produced 2.4 lbs of force with a peak current of seven (7) amps, and 28 ohms. Producing a new coil of 1540 turns increased the resistance and reduced the current and force generated. Next, turns were gradually removed and the coil was retested with varying numbers of turns. As expected, the resistance decreased as the number of turns decreased, and the current increased. However, a maximum force of 3.15 lbs was produced with 750 turns, after which further reductions in the coil resulted in lower force.

| | 34 AWG | | | | |
|---|---|---|---|---|---|
| test # | Coil turns | ohms | amps peak | force Lbs | notes |
| 1 | 1200 | 28 | 7 | 2.4 | standard coil |
| 2 | 1540 | 31 | 5.2 | 1.7 | made with new wire |
| 3 | 1400 | 27.75 | 5.8 | 1.85 | removed wire |
| 4 | 1300 | 25.65 | 6.5 | 2.1 | heated 1.7 lbs 6.2 A |
| 5 | 1200 | 22.05 | 7.2 | 2.1 | heated 1.8 lbs 7 A |
| 6 | 1100 | 19.56 | 8 | 1.8 | heated 1.75 lbs |
| 7 | 1000 | 17.33 | >8 | 2.3 | |
| 8 | 900 | 15.45 | >8 | 2.45 | |
| 9 | 850 | 14.75 | >8 | 2.7 | heated 2.5 lbs |
| 10 | 800 | 12.9 | >8 | 2.55 | heated 2.3 |
| 11 | 750 | 11.98 | >8 (11) | 3.15 | heated: 2.3 lbs@13.56 ohm, 62 C./ 2.7 lbs@12.7 ohm, 40 C. |
| 12 | 725 | 11.31 | | 2.8 | limit reached |

Another test was conducted using an SCR to energize the coil, rather than directly controlling the relay. The results are below:

New Testing conducted with SCR firing the coils in place of direct Relay control Standard production 34 AWG coils used and wire removed as tested.

| test | Coil turns | ohms | amps peak | force Lbs | notes |
|---|---|---|---|---|---|
| 1 | 1200 | 24 | 6.3 | 2.3 | coil 0.348"OD |
| 2 | 1100 | 21.3 | 7.28 | 2.5 | |

-continued

New Testing conducted with SCR firing the coils in place of direct Relay control Standard production 34 AWG coils used and wire removed as tested.

| test | Coil turns | ohms | amps peak | force Lbs | notes |
|---|---|---|---|---|---|
| 3 | 1000 | 18.8 | 8.16 | 2.4 | 2.1 lbs@45 C. |
| 4 | 900 | 16.51 | | 2.5 | 2.1 lbs @ 45 C., 1.85 lbs @ 57 C. |
| 5 | 800 | 14.29 | | 2.5 | coil 0.287"OD, 2.3 lbs @43 C., 2.1 lbs @ 58 C., 2 lbs @ 66 C. NO SCR failures |
| 6 | 750 | 17.75 | | 1.6 | 1.2 lbs @ 28 C. |

Next, a series of experiments were conducted by winding two or more separate coils together in various configurations. In each of the configurations described below, the coil wires are preferably wound around a bobbin helically and tightly, one layer at a time, with each layer wound outside the prior layer. Accordingly, the number of turns per layer of wire is related to the length of the bobbin divided by the diameter of the wire including insulation, and the volume of the resulting coil is substantially related to the diameter of wire and the total number of turns of wire in the coil.

FIG. 1 illustrates a first coil configuration, in which a solenoid 100 was wound with a primary coil 102 wound together with a secondary coil 104. Accordingly, both the primary coil 102 and the secondary coil 104 have a start at the inside diameter (ID) of the solenoid, and have their ends at the outside diameter (OD) of the solenoid. The primary and secondary coils were wound together for 865 turns. The solenoid was tested by energizing the primary and secondary coils individually, and then by energizing both coils together. The results are shown in the table below:

New test
Coil wound with wire pair together to 865 turns

| | Coil turns | ohms | amps peak | force Lbs | notes |
|---|---|---|---|---|---|
| 1 | 865 coil1 | 18.02 | | 1.4 | |
| | 865 coil2 | 18.03 | | 1.4 | |
| | both active | | | 3.7 | Resultant 32% gain in force |

As will be appreciated, the force of each coil energized separately was 1.4 lbs, while the force of the coils energized together was 3.7 lbs, or 32% higher than simply adding the force of each coil together.

Figure 2:
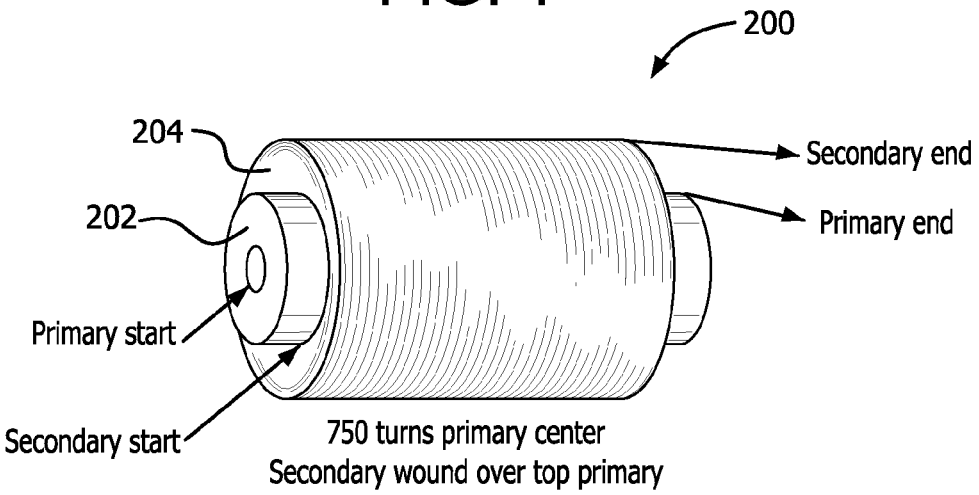
FIG. 2 is a diagram illustrating a second coil according to a second embodiment of the present invention.

As shown in FIG. 2, a second solenoid 200 was wound with the primary coil 202 would first, for 750 turns, and the secondary coil 204 was then wound on top of the primary coil for 1333 turns. The solenoid 200 was tested with the primary and secondary coils energized separately, and then together. Next 133 turns were removed from the secondary coil 204 and the solenoid 200 was retested. Finally, 100 additional turns were removed from the secondary coil 204 and the solenoid 200 was retested again. The test results are shown below:

Primary coil 750 turns, secondary on top = 1333 turns

| | Coil turns | ohms | amps peak | force Lbs | notes |
|---|---|---|---|---|---|
| 1 | primary 750 | 13.66 | 11 | 2.4 | |
| | $2^{nd}$ 1333 | 34.5 | 4.52 | 1.5 | |
| | both active | | | 4.7 | Resultant 20% gain in force |

-continued

Primary coil 750 turns, secondary on top = 1333 turns

| | Coil turns | ohms | amps peak | force Lbs | notes |
|---|---|---|---|---|---|
| 2 | removed 133 off $2^{nd}$ | | | | |
| | primary 750 | 13.66 | 11 | 2.4 | |
| | $2^{nd}$ 1200 | 29.6 | 4.88 | 1.2 | |
| | both active | | | 4.8 | Resultant 33% gain in force |
| 3 | removed 100 off $2^{nd}$ | | | | |
| | primary 750 | 13.66 | 11 | 2.4 | heated 1.8 lbs @ 58 C. |
| | $2^{nd}$ 1100 | 26.48 | 5.76 | 1.1 | heated 0.8 lbs @ 55 C. |
| | both active | | | 5.2 to 4.6 | 3.6 lbs @ 51 C., 3.3 lbs @ 58 C. Resultant 48% gain in force |

As will be appreciated, there was a performance gain when both coils were energized together, as compared to simply adding the force generated by each coil separately. The gain increased the closer the size of the primary coil was to the secondary coil. In the first trial the gain was 20%, in the second trial the gain was 33%, and in the third trial, when the secondary coil was closest in number of windings to the primary coil, the gain was 48% over simple addition of the forces generated by the primary and secondary windings separately.

Figure 3:
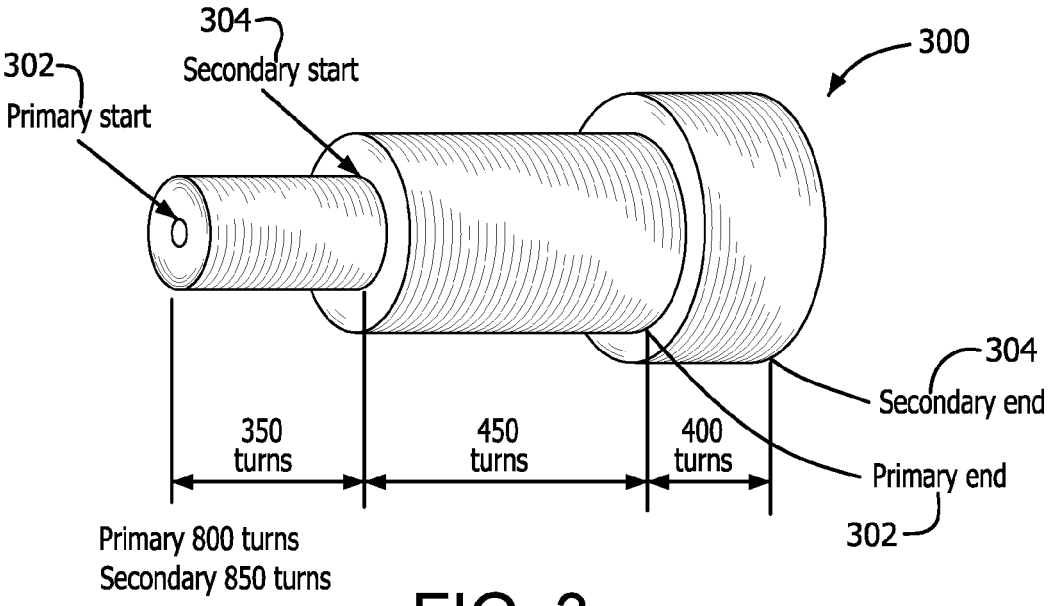
FIG. 3 is a diagram illustrating a third coil having primary and secondary windings partially wound together according to a third embodiment of the present invention.

FIG. 3 illustrates a third solenoid 300 that was wound with a first portion of the primary coil 302 wound first for 350 turns. The secondary coil 304 was then wound together with the primary coil 302 (that is, the primary and secondary wires were wound at the same time, side-by-side) for 450 turns. Next, the primary coil 302 was ended, and the secondary coil 304 was wound on top of the foregoing portion for an additional 400 turns. Thus the primary winding 302 included a total of 800 turns and the secondary winding 304 included a total of 850 turns. The third coil 300 was tested with the primary and secondary windings energized separately, and then together. The results are shown below.

new test
Primary coil 800 turns, secondary 850 turns as shown, but wound ontop as one coil

| | Coil turns | ohms | amps peak | force Lbs | notes |
|---|---|---|---|---|---|
| 1 | primary 800 | 14.65 | 10 | 1.9 | 1.2 lbs @ 60 C. |
| | $2^{nd}$ 850 | 17.16 | 8.6 | 1.2 | 0.7 lbs @ 60 C. |
| | both active | | | 4.4 | 3 lbs @ 43 C., 2.6 lbs @ 52 C., 2.4 lbs @ 60 C. Resultant 42% gain in force |

As will be appreciated, the force generated by the primary coil energized along was 1.9 lbs. The force generated by the secondary coil energized alone was 1.2 lbs. When both coils were energized together, however, the resultant force is significantly higher than the mere sum of the individual component forces generated by the coils. In other words, the coils generated a force of 4.4 lbs when energized together, which is a 42% gain over the sum of the forces generated by the coils when energized separately.

Figure 4:
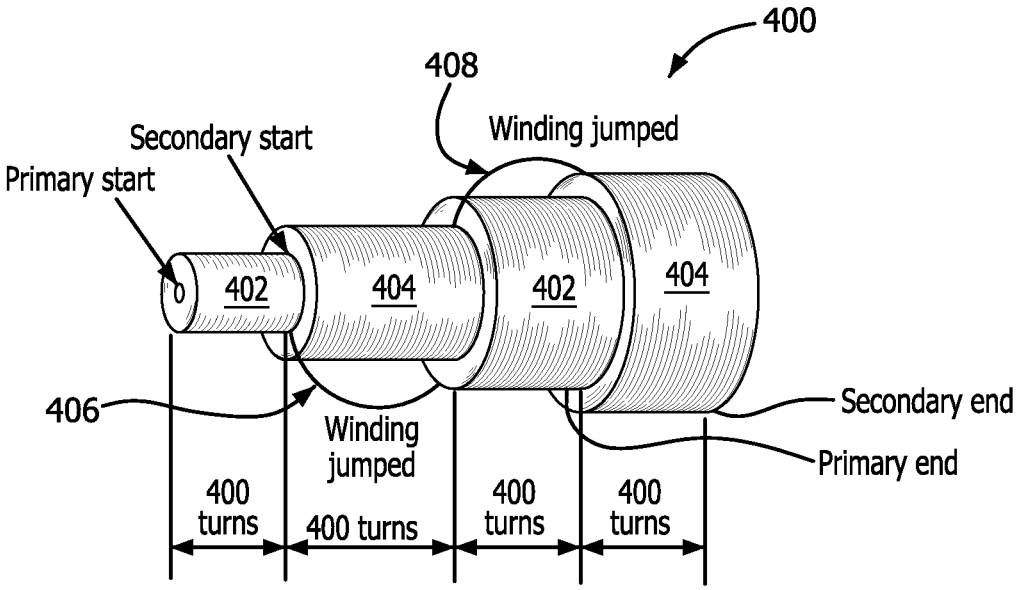
FIG. 4 is a diagram illustrating a fourth coil having interleaved primary and secondary windings according to a fourth embodiment of the present invention.

FIG. 4 illustrates a fourth solenoid 400 that was wound with alternating layers of primary coil 402 and secondary coil 404. As illustrated, the primary coil 402 was first wound for 400 turns, then the secondary coil 404 was wound for 400 turns. Next, the primary winding 402 was wound again on top of the secondary winding. The two portions of primary winding were connected by a jumper 406. Similarly, the secondary coil 404 was wound on top of the foregoing portions for an additional 400 turns, with a jumper 408 connecting the two portions of the secondary coil 404. The solenoid was tested by energizing the primary and secondary coils separately, and then together. The results are shown below:

| new test<br>Primary coil 800 turns, secondary 800 turns as shown, but wound on top as one coil | | | | | |
|---|---|---|---|---|---|
| | Coil turns | ohms | amps peak | force Lbs | notes |
| 1 | primary 800 | 17.77 | 9.76 | 1.6 | 1.23bs @ 66 C. |
| | $2^{nd}$ 760 | 15.22 | 8.36 | 1.2 | 1.0 lbs @ 66 C. |
| | both active | | | 4.2 | 3.2 lbs @ 66 C. Resultant 50% gain in force |

As can be seen, the resulting force gain for this configuration was 50%, better than the previous embodiments. However, this configuration proved more difficult to wind than previous embodiments, and the OD was larger than desired.

Figure 5B:
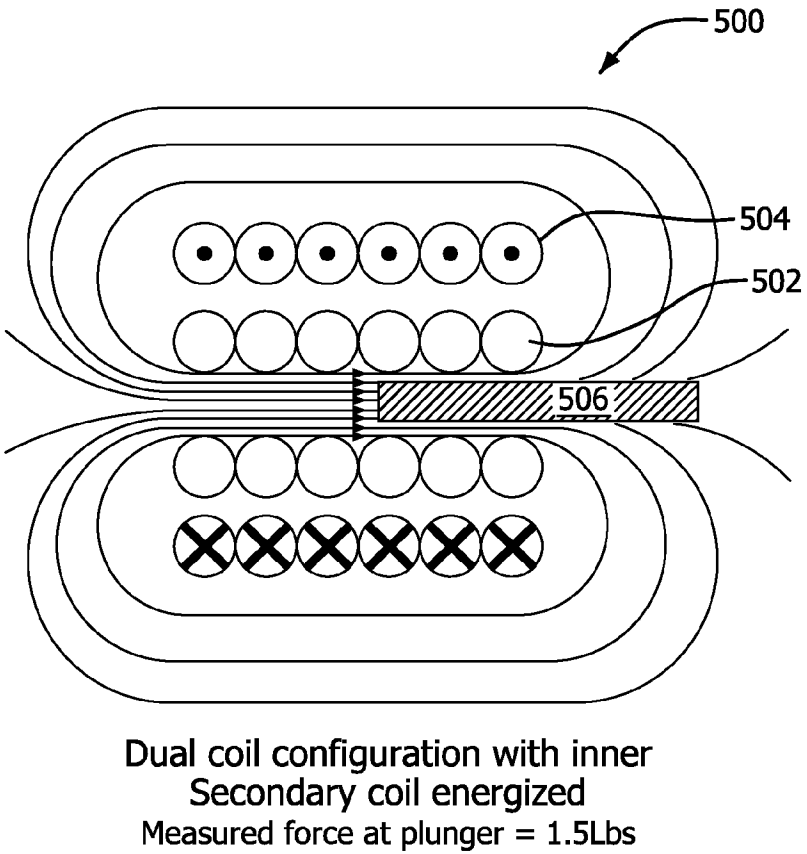
FIGS. 5A-5C illustrate a force multiplying effect of a dual coil solenoid according to an exemplary embodiment of the invention.
Figure 5A:
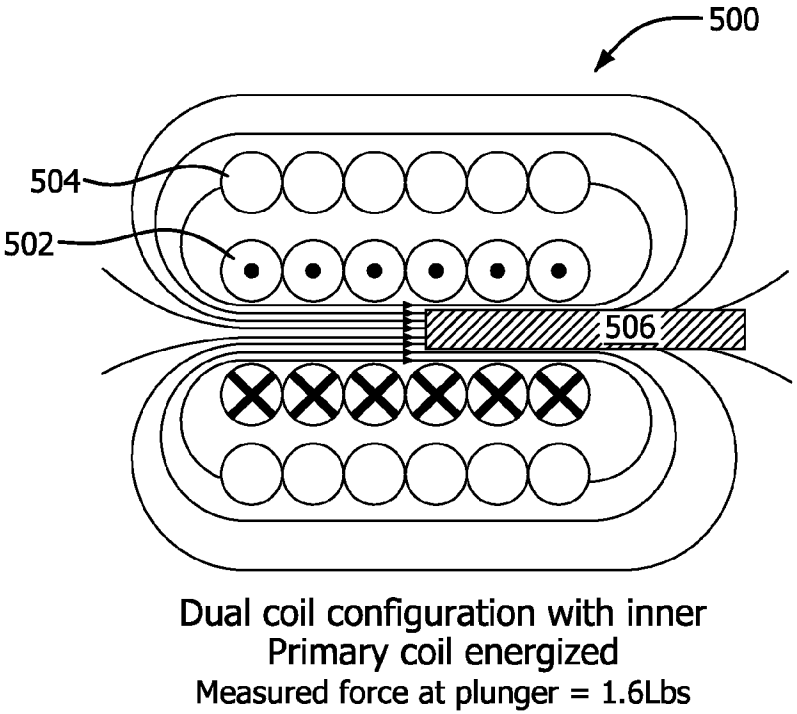
Figure 5C:
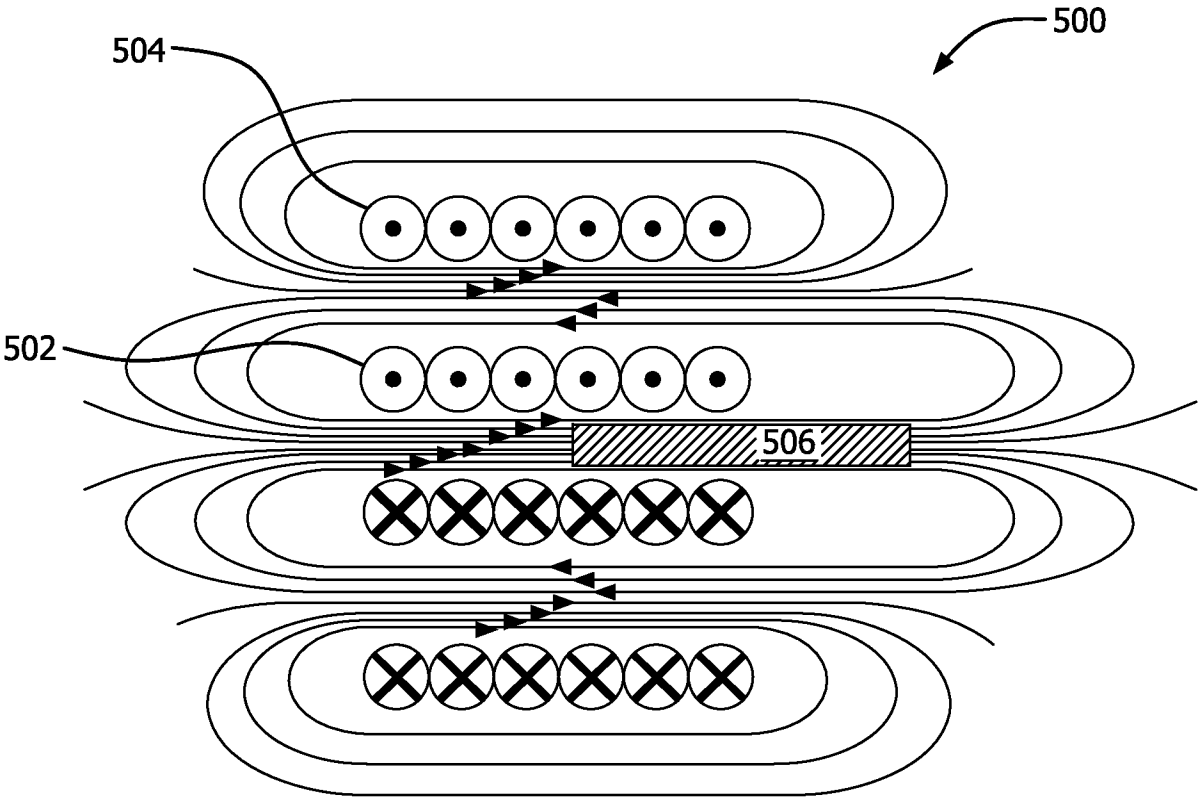

By operating two separate coils simultaneously, the magnetic field is focused closer to the central axis of the plane of the solenoid plunger, thus yielding higher forces than the added forces of the field generated by either coil alone. The focusing of the magnetic field onto the axis of a solenoid plunger will now be described in further detail in connection with FIGS. 5A-5C. FIGS. 5A-5C illustrate a solenoid 500 having a primary coil 502 and a secondary coil 504 that is preferably wound outside the primary coil 502. When one or both of the coils 502, 504 are energized, and magnetic flux is generated that imparts a force on a plunger 506 located in the core of the solenoid 500.

FIG. 5A illustrates the solenoid 500 with the primary coil 502 energized and the secondary coil 504 not energized. The primary coil 502 generates a magnetic field having a particular flux or field density in the core that imparts a first force on the plunger 506. Preferably, the first force generated by the primary coil 502 is preferably greater than a threshold force required to move a latch device of a ground fault circuit interrupter. In other words, the first force generated by the primary coil 502 when energized independently should be enough to trip a GFCI device in which the solenoid 500 is installed.

FIG. 5B illustrates the solenoid 500 with the secondary coil 504 energized and the primary coil 502 not energized. The secondary coil 504 generates a magnetic filed having a particular flux or field density in the core of the solenoid that imparts a second force on the plunger 506. The magnetic field generated by the secondary coil 504 is generally weaker per unit winding and current since the wires of the secondary coil 504 are wound outside the primary coil 502 and therefore are farther away from the core of the solenoid 500 and the plunger 506. It is desirable that the first force generated by the primary coil 502 and the second force generated by the secondary coil 504 be closely matched, such that the first force generated by the primary coil 502 and the second force generated by the secondary coil 504 are each greater than the threshold force required to trip a GFCI device, as described above. Accordingly, the wire gauge, number of windings, and other parameters of the primary and secondary coils 502, 504 are preferably selected to closely match the forces generated by the coils when they are independently energized, such that the forces generated by each coil are separately greater than a threshold force required to trip a GFCI device. The parameters of the coils are also preferably selected so that the solenoid, including both primary and secondary coils 502, 504 has an OD smaller than a predetermined size requirement.

FIG. 5C illustrates the solenoid 500 with the primary coil 502 and the secondary coil 504 energized together. As illustrated the magnetic field generated by the secondary coil 504 essentially "squeezes" the magnetic field generated by the primary coil 502 within the core of the solenoid. As a result the magnetic field density is increased along the axis of the plunger 506, compared to what would be expected by simply adding the magnetic fields generated by the primary coil 502 and the secondary coil 504 energized independently. In the example illustrated in FIGS. 5A-5C, the primary coil 502 generates a force of 1.6 lbs on the plunger 506 when energized independently. The secondary coil 504 generates a force of 1.5 lbs on the plunger 506 when energized independently. However, advantageously, the force generated when the primary and secondary coils 502, 504 are energized together is 4.4 lbs, which represents of 42% gain over a simple sum of the forces generated by the coils separately (3.1 lbs).

The embodiment described above has several important advantages over conventional solenoids used in GFCI devices. First, having two separate coils capable of independent energization provides an important failsafe backup operation. Accordingly, even if one of the coils becomes short circuited or open circuited, the remaining coil can generate enough force to trip the GFCI device. Second, when both coils are operating together, the combined force is amplified such that a smaller solenoid can produce more force. Thus, a solenoid according to embodiments of the present invention can fit into smaller spaces while producing greater force, and having greater tolerance for operating environments such as temperature ranges. Embodiments of the present invention enable the design of smaller GFCI devices, and/or permit the design of GFCI devices that include additional components without increasing the overall size of the GFCI housing.

Figure 6:
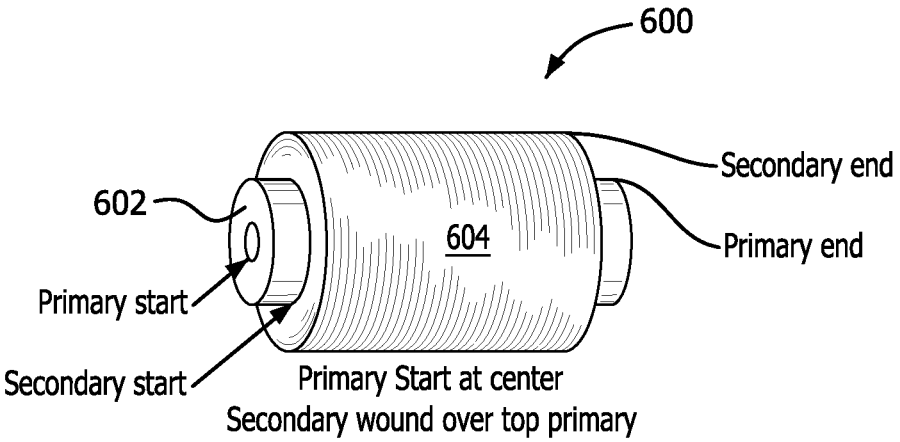
FIG. 6 is a diagram illustrating a fifth coil according to a fifth embodiment of the present invention.

FIG. 6 illustrates a fifth coil 600 that was wound and tested. The fifth coil 600 was substantially similar to the first coil 200 illustrated in FIG. 2, except that different gauge wires were used for the primary and secondary windings. In the coil 600 shown in FIG. 6, the primary coil was formed with 34 AWG wire, and the secondary coil was formed with 33 AWG wire. The primary coil was formed by removing 400 turns from a standard 1200 turn solenoid. The secondary coil 504 was wound for 1000 turns. The results are shown in the following table:

| Coil turns | ohms | amps peak | force Lbs | notes |
|---|---|---|---|---|
| Primary 800 | 14.53 | 10.5 | 2.5 | 34 AWG |
| Secondary 1000 | 21.2 | 7.28 | 1.2 | 33 AWG |
| both active | | | 5 | Resultant 35% gain in force |

As can be appreciated, the resulting force gain was 35% greater than would be expected by simply adding the forces of the individual windings together.

Next, 50 turns were removed from the secondary, and the solenoid was retested, with the following results:

| Coil turns | ohms | amps peak | force Lbs | notes |
|---|---|---|---|---|
| Primary 800 | 14.53 | 10.5 | 2.5 | 34 AWG |
| Secondary 950 | 19.65 | 7.8 | 1.4 | 33 AWG |
| Both active | | | 5.5 | Note highest yield single pulse Resultant 42% gain in force |

As can be appreciated from the above table, the force generated by the secondary winding alone was 1.4 lbs, which is greater than the 1.2 lbs in the previous test when the secondary winding had 1000 turns. Also the force of the combined windings was 5.5 lbs, a 42% gain over simply adding the forces of the individual windings together.

Next, another 50 turns were removed from the secondary, and the solenoid was tested again, with the following results:

| Coil turns | ohms | amps peak | force Lbs | notes |
|---|---|---|---|---|
| Primary 800 | 14.53 | 10.5 | 2.5 | 34 AWG |
| Secondary 900 | 18.2 | 8.68 | 1.3 | 33 AWG |
| Both active | | | 5.3 | Resultant 40% gain in force |

Accordingly, as can be appreciated from the above table, this configuration did not perform as well as the prior configuration, either in total force produced by the combined windings (5.3 lbs) or in percent gain over the addition of forced produced by the individual windings energized separately (40%). Of the three configurations tested, the 950 turn configuration proved optimal.

Figure 7:
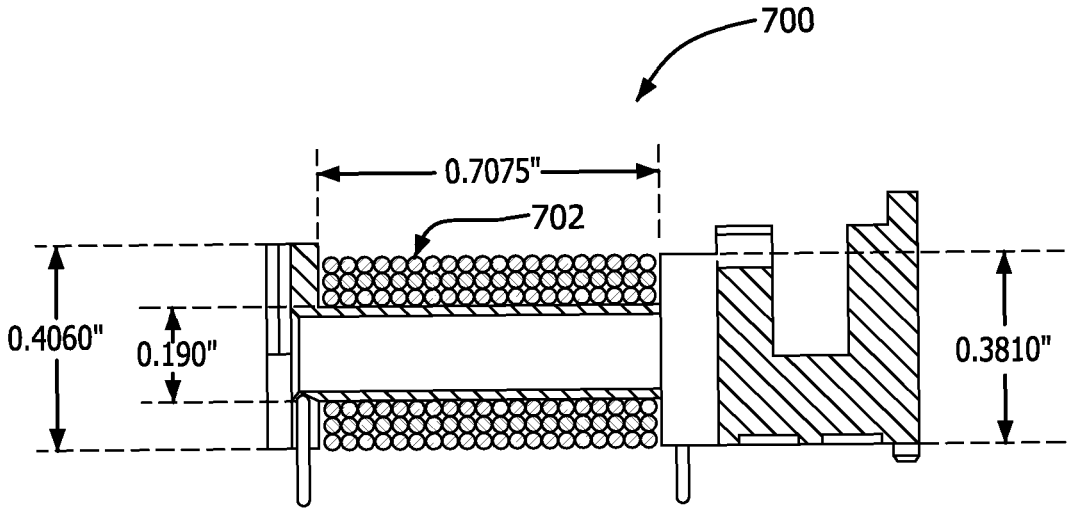
FIG. 7 illustrates an empty bobbin on which a coil is wound according to an embodiment of the present invention.
Figure 8:
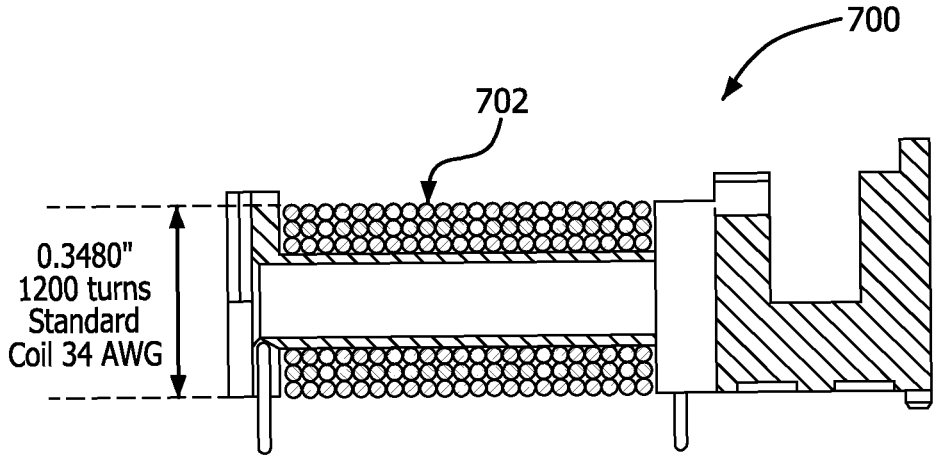
FIG. 8 illustrates a standard 1200 winding coil.

FIG. 7 illustrates a typical empty plastic bobbin 700 of a solenoid, on which wire windings are wound. The typical dimensions, as shown, are 0.7075" long, ID 0.190", and OD 0.4060". FIG. 8 illustrates the plastic bobbin 700 with a standard 1200 turn winding 702 wound on the bobbin 700.

Figure 9:
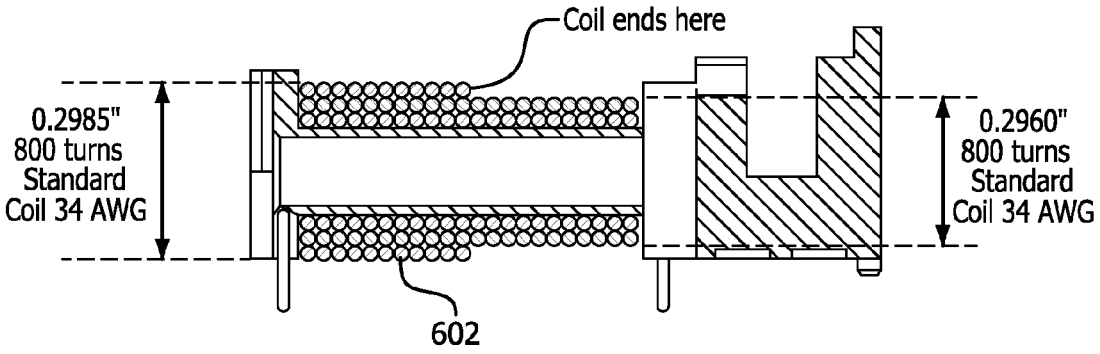
FIG. 9 illustrates a primary coil wound on a bobbin according to an embodiment of the present invention.
Figure 10:
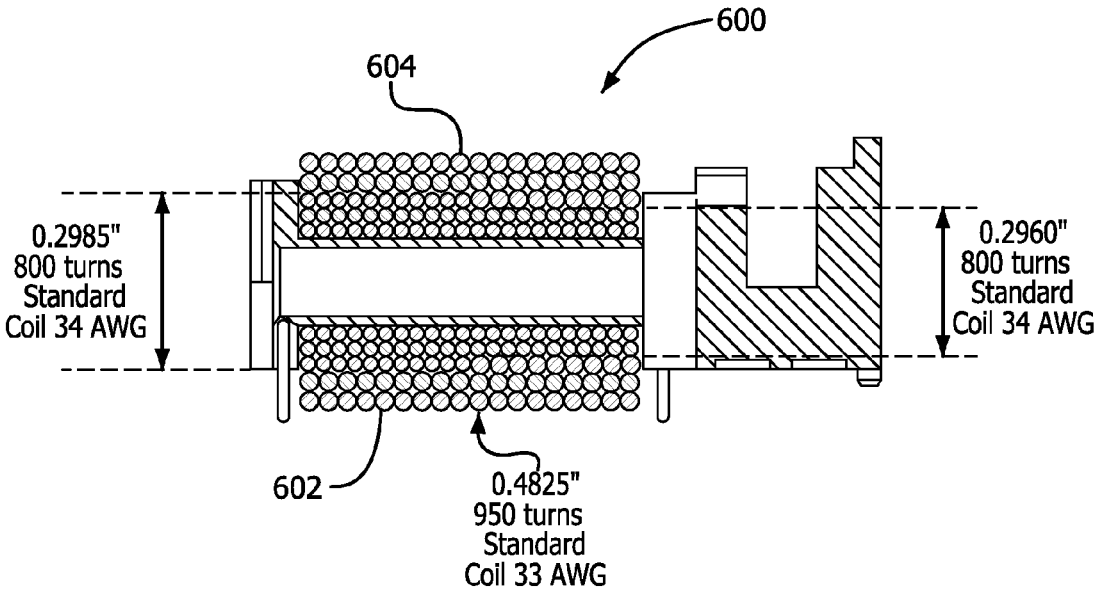
FIG. 10 illustrates primary and secondary coils wound on a bobbin according to an embodiment of the present invention.

FIGS. 9 and 10 illustrate the construction of a solenoid according to the embodiment described in connection with FIG. 6, with a primary winding 602 of 800 turns of 34 AWG wire and a secondary winding 604 of 950 turns of 33 AWG wire. As illustrated in FIG. 9, the primary winding ends in an incomplete row, and accordingly, the OD of the primary winding is 0.2985" at one end of the bobbin, and 0.2960" at the other end of the bobbin. As shown in FIG. 10 the OD of the solenoid is 0.4725". This OD was undesirably large, and the force generated was more than needed.

Another test was conducted using a construction substantially similar to the fifth coil 600 shown in FIG. 6, but with smaller diameter 35 AWG wire used for the primary winding, rather than 34 AWG, and 33 AWG wire used for the secondary winding. This resulted in the individual forces imparted by the separate windings being better matched, and a reduced OD. The results are shown in the table below:

| Coil turns | ohms | amps peak | force Lbs | notes |
|---|---|---|---|---|
| Primary 800 | 17.58 | 8.68 | 1.6 | 35 AWG |
| Secondary 950 | 19.06 | 8.08 | 1.35 | 33 AWG |

-continued

| Coil turns | ohms | amps peak | force Lbs | notes |
|---|---|---|---|---|
| Both active | | | 4.2 | 3.3 Lbs @ 67 C., 3.1 Lbs @ 72 C. Resultant 45% gain in force |

As can be appreciated from the above table, the above configuration resulted in a 45% gain in force over the simple addition of forces generated by the individual windings separately.

When wire was wound on the bobbin or spool in single tightly wound layers, it was found that the following number of turns were wound in one complete row:

33 AWG=87 turns

34 AWG=96 turns

35 AWG=118 turns

Figure 11:
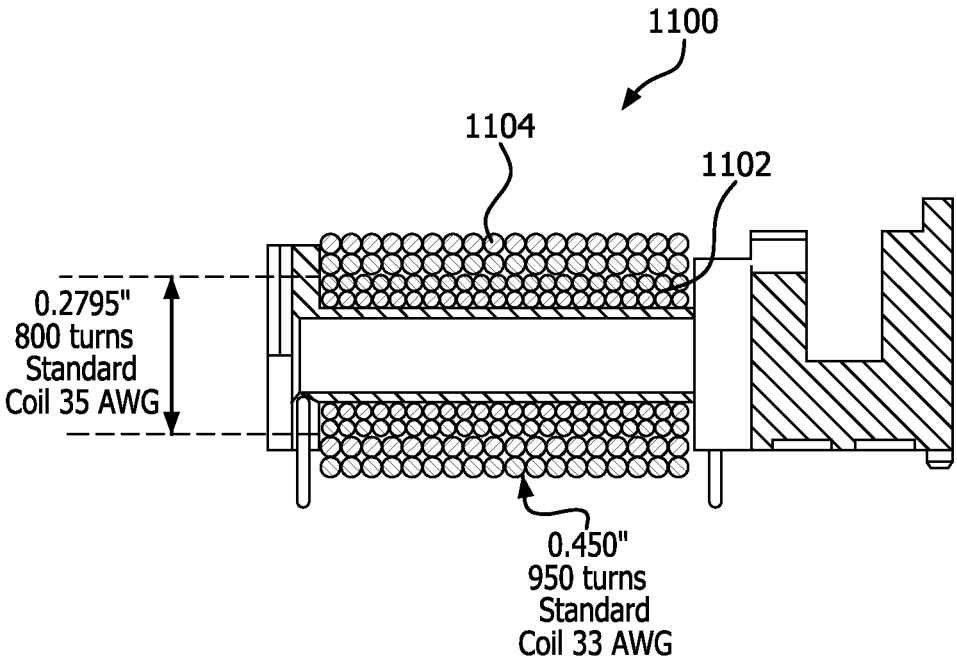
FIG. 11 illustrates another embodiment of the present invention.

FIG. 11 illustrates a preferred embodiment of a coil 1100 that was wound with the primary coil 1102 being made of 35 AWG wire. Preferably, the coil is wound such that the outer layer of the coil is completed, making it easier to pull the primary winding ending over the secondary coil to fix to the termination pin. This may be accomplished by selecting the number of turns such that the tightly wound coil ends with a complete layer, or by loosely winding the last few turns to span the outer layer of the coil. The secondary coil 1104 was made of 33 AWG wire and 950 turns. The primary coil 1102 has a resistance of 16.58 ohms and when energized resulted in a current of 8.84 to 8.92 amps and a force of 1.5-1.6 lbs at an operating temperature of 27° C. The secondary coil 1104 has a resistance of 18.4 ohms, and when energized resulted in a current of 7.92 to 8.16 amps and a force of 1.35-1.5 lbs at an operating temperature of 26° C. The force generated on the plunger when both coils are operated together is 4.4 lbs at 26° C. (or a 42%-54% gain). The plunger OD is preferably 0.125", and the solenoid OD is preferably 0.450".

Figure 12B:
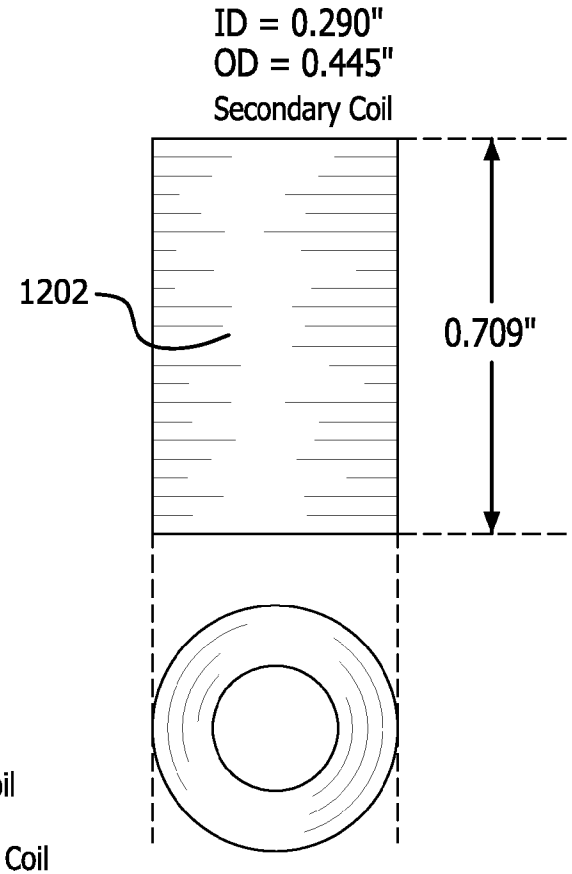
FIGS. 12A-12C illustrate preferred dimensions of a dual coil solenoid according to an exemplary embodiment of the present invention.
Figure 12C:
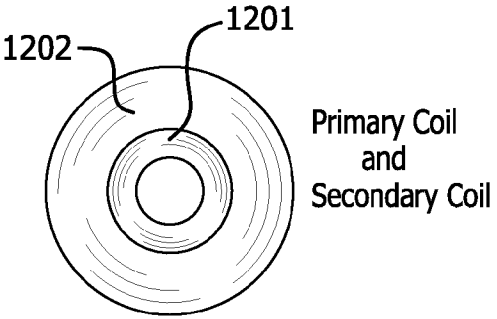
Figure 12A:
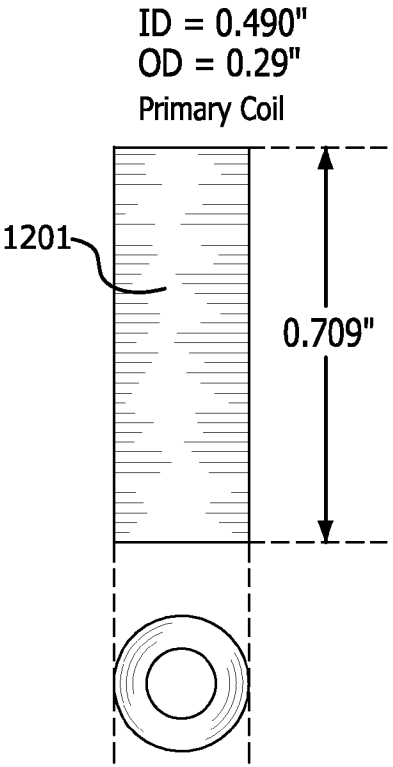

An exemplary embodiment of a solenoid constructed according to an embodiment of the invention is illustrated in FIGS. 12A-12C. The primary coil 1201 is wound onto a bobbin having a diameter of 0.190 inches and a length of 0.709 inches. Accordingly, the primary coil has an inside diameter (ID) of 0.190 inches. The primary coil is preferably formed of 35 AWG wire and is wound for 800 turns on the bobbin, in smooth substantially complete layers. Such a primary coil will have an outside diameter (OD) of 0.290 inches, and a resistance of 18 ohms +/−15%, and is illustrated in FIG. 12A. The secondary coil 1202 is wound outside the primary coil 1201 and has an ID the same as the OD of the primary coil 1201, that is 0.290 inches. The secondary coil is preferably formed of 33 AWG wire and is wound for 950 turns on the bobbin. Such a secondary coil will have an outside diameter (OD) less than 0.445 inches, and typically 0.440 inches. The resistance of the secondary coil is 16.9 ohms +/−15%. The secondary coil is illustrated in FIG. 12B, and an end view of both coils is illustrated in FIG. 12C. The beginning and end of each coil are available for connection to other circuit components of a device which incorporates and utilizes the dual coil solenoid, such as a GFCI, as may be needed.

Figure 13:
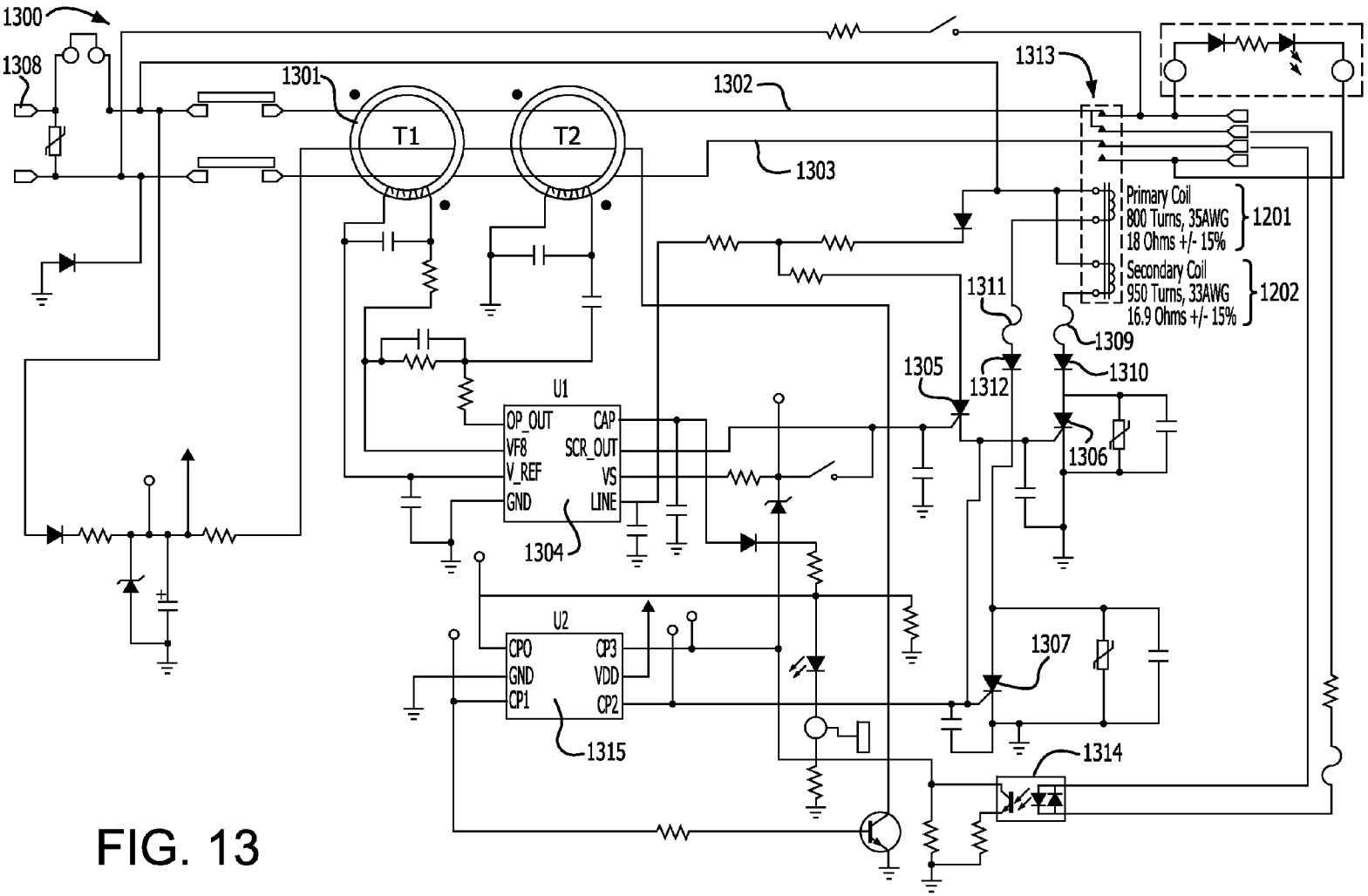
FIG. 13 illustrates an electrical schematic of a GFCI device incorporating the dual coil solenoid device according to an embodiment of the present invention.

FIG. 13 is circuit schematic of a GFCI device 1300 utilizing a dual coil solenoid according to another embodiment of the present invention. In operation, sense coil 1301 senses a net current between the main hot and neutral conductors 1302 and 1303, and provides a signal to sense controller 1304. When sense controller 1304 senses a signal indicative of a differential current exceeding a predetermined threshold on the hot and neutral conductors 1302 and 1301, the sense controller provides a fault signal (SCR_OUT) to the gate of SCR 1305. The SCR 1305 turns on when the fault signal is applied to the gate of SCR 1305, and in turn provides a gate signal to SCRs 1306 and 1307. A first current path is formed between a line hot terminal 1308 of the GFCI device 1300 and ground, passing first through secondary coil 1202, fuse 1309, diode 1310 and SCR 1306. A second current path is formed between the line hot terminal 1308 and ground, passing first through primary coil 1201, fuse 1311, diode 1312, and SCR 1307.

As will be appreciated, under normal conditions, when a fault is sensed, both SCRs 1306 and 1307 will turn on, and both the primary and secondary coils 1201 and 1202 will be energized, imparting a combined force on a plunger to trip open a set of contacts 1313 to remove input power from load and receptacle (face) contacts. Preferably, a device such as an opto-isolator 1314 provides a confirming signal to a monitoring controller 1315 to confirm proper operation of the trip circuit and opening of the contacts 1313. If contacts 1313 do not open in response to a fault signal, monitoring controller 1315 preferably enters an end-of-life state.

As will further be appreciated, in the event that either the primary coil 1201 or the secondary coil 1202 of the solenoid becomes damaged, such as by short circuit or open circuit in the coil wire, the remaining coil is advantageously fully capable of generating enough force to trip the device and safely open the contacts 1313. Further, if either of the SCRs 1306 and 1307 fail, the remaining SCR is advantageously capable of energizing its corresponding solenoid coil 1201 or 1202 to trip the device and safely open the contacts 1313.

What is claimed is:

1. A dual coil solenoid comprising:

a bobbin having a central axial opening adapted to receive an armature, the bobbin having a diameter less than 0.2 inches on which a primary coil is wound;

the primary coil comprising 35 AWG wire wound helically on said bobbin in layers, the primary coil having less than 850 turns, an ID less than 0.2 inches and an OD less than 0.3 inches;

a secondary coil comprising 33 AWG wire wound helically outside said primary coil in layers, the secondary coil having less than 1000 turns, an ID less than 0.3 inches and an OD less than 0.45 inches.

2. The dual coil solenoid of claim 1, wherein said primary coil comprises 800 turns.

3. The dual coil solenoid of claim 1, wherein said secondary coil comprises 950 turns.

4. The dual coil solenoid of claim 1, wherein said secondary coil has an OD less than 0.445 inches.

5. The dual coil solenoid of claim 1, wherein said secondary coil has an OD of 440 inches.

6. The dual coil solenoid of claim 1, wherein said primary and secondary coils have a length less than 0.75 inches.

7. The dual coil solenoid of claim 1, wherein said primary and secondary coils have a length of 0.709 inches.

8. The dual coil solenoid of claim 1, wherein said primary coil has a resistance of 18 ohms +/−15% and the secondary coil has a resistance of 16.9 ohms +/−15%.

9. The dual coil solenoid of claim 1, wherein the primary coil imparts of force between 1.5 and 1.6 lbs on the armature when the primary coil is energized and the secondary coil is not energized.

10. The dual coil solenoid of claim 9, wherein the secondary coil imparts a force between 1.35 and 1.5 lbs on the armature when the secondary coil is energized and the primary coil is not energized.

11. The dual coil solenoid of claim 10, wherein the primary and secondary coils impart a combined force of more than 2.85 lbs on the armature when the primary and secondary coils are energized together.

12. The dual coil solenoid of claim 10, wherein the primary and secondary coils impart a combined force of more than 3.1 lbs on the armature when the primary and secondary coils are energized together.

13. The dual coil solenoid of claim 10, wherein the primary and secondary coils impart a combined force of more than 4.4 lbs on the armature when the primary and secondary coils are energized together.

* * * * *